US005366352A

United States Patent [19]

Deblois et al.

[11] Patent Number: 5,366,352

[45] Date of Patent: Nov. 22, 1994

[54] THERMOSTATIC COMPRESSOR SUCTION INLET DUCT VALVE

[76] Inventors: Raymond L. Deblois, 76 Carriage Dr., Tolland, Conn. 06084; David G. Cutts, 41 Wadsworth St., Glastonbury, Conn. 06033; Anthony J. Marchese, 314 Thatcher Ter., Neshanic Station, N.J. 08853

[21] Appl. No.: 166,368

[22] Filed: Dec. 13, 1993

[51] Int. Cl.[5] ..... F04B 21/02

[52] U.S. Cl. ..... 417/292; 417/902

[58] Field of Search ..... 417/292, 298, 366, 368, 417/902

[56] References Cited

U.S. PATENT DOCUMENTS

| | | | |
|---|---|---|---|
| 3,969,040 | 7/1976 | Hamm et al. | 417/292 |
| 5,141,407 | 8/1992 | Ramsey et al. | 417/292 |
| 5,186,613 | 2/1993 | Kotlarek et al. | 417/292 X |
| 5,240,391 | 8/1993 | Ramshankan et al. | 417/366 X |
| 5,248,244 | 9/1993 | Ho et al. | 417/292 |

*Primary Examiner*—Richard E. Gluck

[57] ABSTRACT

One or more thermostatically responsive valves are positioned to regulate the diversion of suction gas flow over the motor to cool the motor. The valves are responsive to motor temperature and only open when motor cooling is required.

8 Claims, 5 Drawing Sheets

THERMOSTATIC COMPRESSOR SUCTION INLET DUCT VALVE

BACKGROUND OF THE INVENTION

In low side hermetic compressors all or most of the shell is filled with gas at suction pressure. The suction gas returns to the compressor at a relatively low temperature and it is commonly used to cool the motor. Cooling the motor with the suction gas warms the suction gas and reduces its density, thereby resulting in less mass being compressed for the same compressor displacement.

U.S. Pat. No. 5,055,010 is directed to a suction baffle for a low side hermetic scroll compressor. The suction baffle is secured to the shell and includes a "generously sized dome" which is "substantially centered vertically and circumferentially on (the) inlet port". Suction gas entering the compressor will tend to impinge upon the suction baffle such that entrained oil and liquid refrigerant will tend to collect on the surface and drain downwardly. Suction gas entering the compressor is divided into two flow paths. The first path is downward and is also the path of the separated liquids. Flow from the first path will then flow over and cool the motor. The second path is axially upward along a much longer, confined flow path opening into the interior of the shell. The reference is silent as to the division of the flows by percentage and as to their exact paths and recombination. With the symmetrically located dome facing the inlet, it is equally likely to divert the flow downwardly as upwardly. With a relatively very short path into the shell in the region of the motor, it is likely that at least half of the flow will be diverted downwardly and will flow over and cool the motor.

Commonly assigned U.S. Pat. No. 5,240,391 diverts a small amount, e.g. 15%, of the suction gas over the motor to cool the motor. After flowing over and cooling the motor, the diverted suction gas is aspirated into the major flow and supplied to the inlet of the scrolls for compression.

Because motors are designed to run at an elevated temperature, it is only necessary to cool them to their desired operating temperature. Any benefits to the motor from additional cooling of the motor are outweighed by losses in efficiency due to the heating of the suction gas.

SUMMARY OF THE INVENTION

The continued development of high efficiency motors coupled with the reduction of mechanical friction losses has resulted in continued overall reduction in the shell temperatures of hermetic compressors. In fact, tests have shown that, for the same compressor at the same operating conditions, an increase in motor efficiency of 3% can result in a decrease in motor temperatures of 25–50 degrees F. Accordingly, for certain operating conditions, it may be acceptable to allow little or no suction gas to be circulated throughout the shell to cool the motor. For other conditions, when more motor cooling is required than can be conducted through the shell and convected to the ambient air, a greater amount of suction gas could be circulated through the shell.

It is an object of this invention to thermostatically control cooling of a motor.

It is another object of this invention to provide a controlled amount of suction gas for motor cooling over a wide range of operating conditions for a hermetic scroll compressor. These objects, and others as will become apparent hereinafter, are accomplished by the present invention.

Basically, a hermetic compressor is provided with one or more temperature activated suction inlet duct valves which open on rise of shell or motor temperature to vary the amount of suction gas circulation. The valves may be bimetallic or shape memory alloy.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
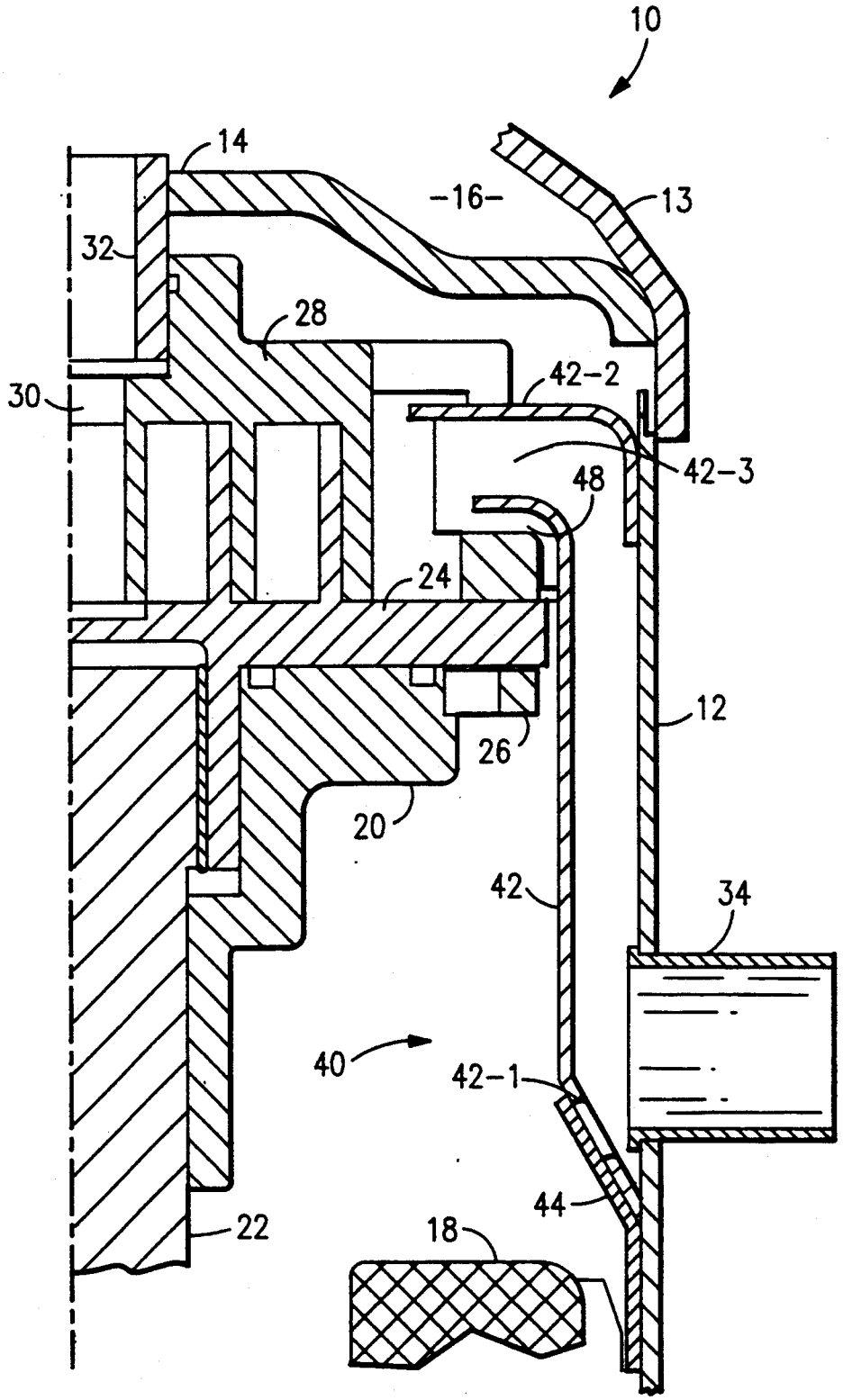
FIG. 1 is a partial sectional view of a vertical, low side hermetic scroll compressor employing the suction inlet duct valve of the present invention.
Figure 2:
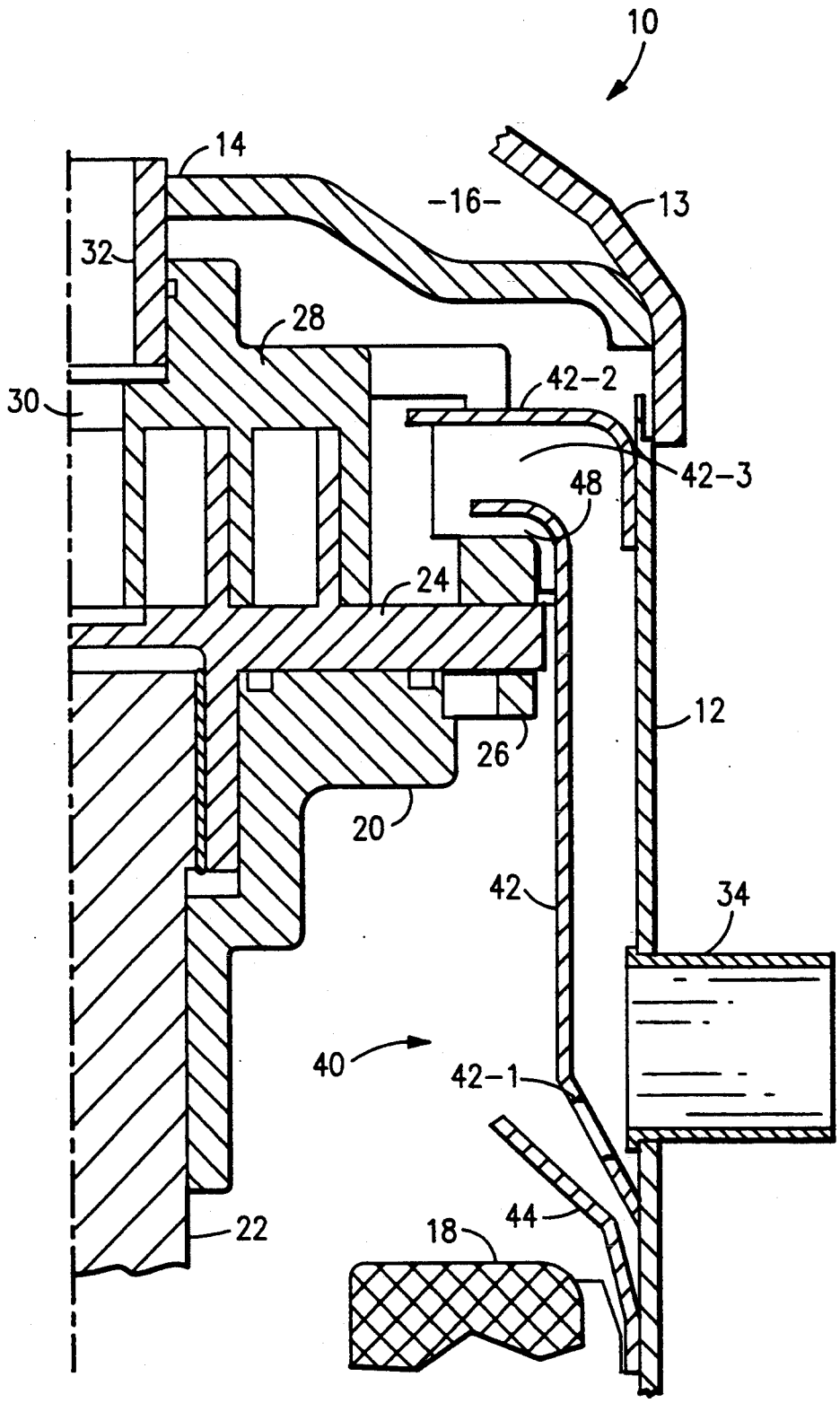
FIG. 2 is a view of the suction inlet duct valve of FIG. 1 in the open position.
Figure 3:
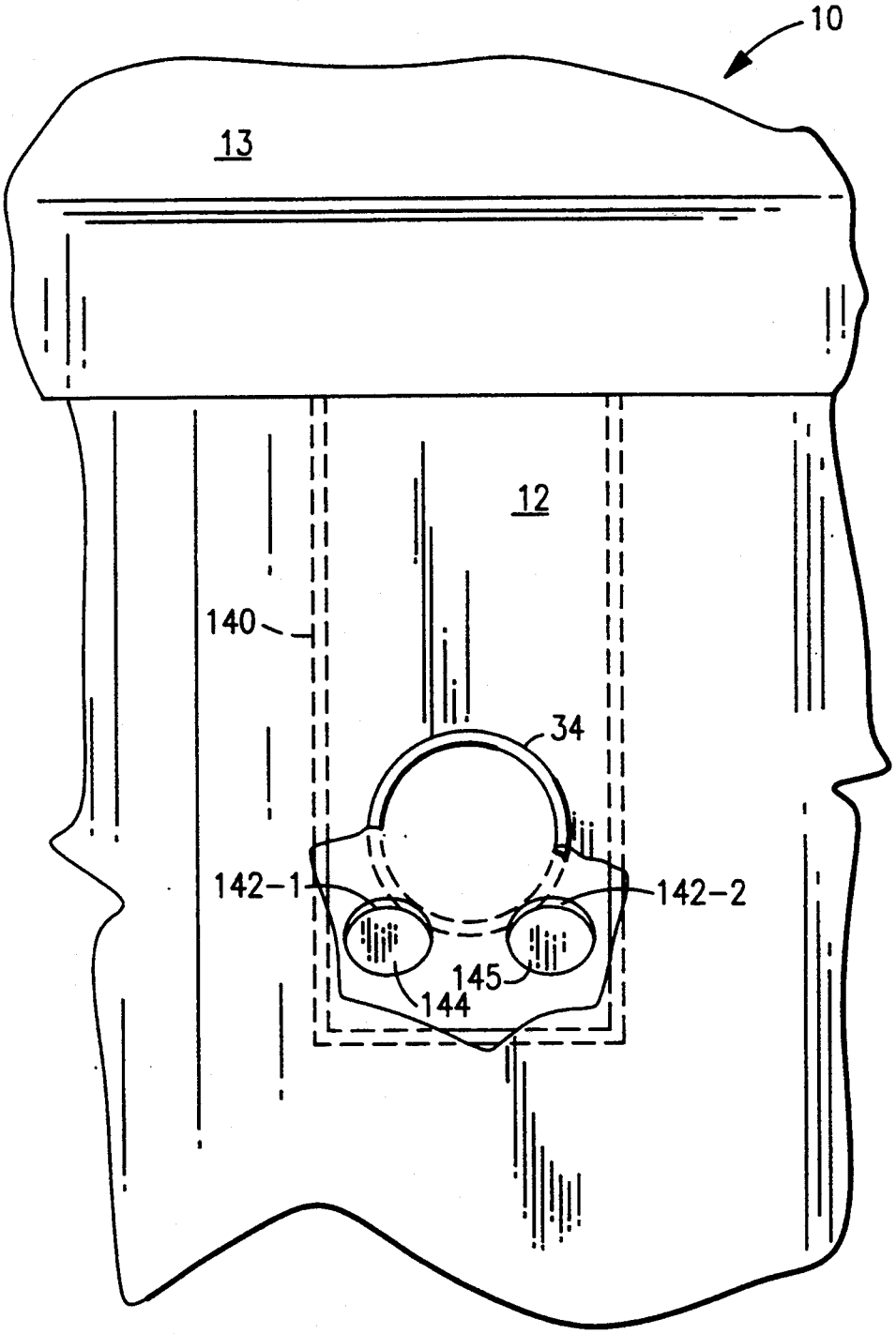
FIG. 3 is a partially cutaway view of a first modified suction inlet duct valve arrangement.

In FIGS. 1–3, the numeral 10 generally designates a vertical, low side, hermetic scroll compressor. Compressor 10 includes a shell 12 having a cover 13. Divider plate 14 coacts with cover 13 to define discharge chamber 16 and to isolate discharge chamber 16 from the interior of shell 12 which is at suction pressure. Crankcase 20 is welded or otherwise suitably secured to shell 12. Crankshaft 22 drives orbiting scroll 24 which is held to an orbiting motion by Oldham coupling 26. Orbiting scroll 24 coacts with fixed scroll 28 to draw gas into the compressor 10, to compress the gas and to discharge the compressed gas via discharge port 30, and discharge tube 32 into discharge chamber 16 from which the compressed gas passes via the discharge outlet (not illustrated) to the refrigeration or air conditioning system. Gas is returned from the refrigeration or air conditioning system and supplied to the compressor 10 via suction inlet 34. The compressor structure described so far is generally conventional. The present invention adds thermostatically valved suction inlet duct structure to the compressor structure. Specifically, suction inlet duct 40 is made up of two members, duct member 42 and thermostatic valve 44. Duct member 42 is fixed to the interior of shell 12. Duct member 42 coacts with the interior of shell 12 to define two flow paths or, more accurately, a flow path with two outlets. Lower outlet or port 42-1 is controlled by thermostatic valve 44 and, when open, the flow discharges into the interior of the shell 12 so as to provide a cooling flow to motor 18. Horizontal leg 42-2 discharges directly into the inlet of scrolls 24 and 28 via outlet 42-3. Horizontal leg 42-2 extends in a generally tangential direction since the inlets of the scrolls 24 and 28 are at the outer peripheries of their wraps. It will be noted that an aspiration inlet 48 is formed between horizontal leg 42-2 and the inlet of the scrolls 24 and 28.

In operation, motor 18 drives crankshaft 22 which causes orbiting scroll 24 to move, but with movement of the orbiting scroll 24 being held to an orbiting motion by Oldham coupling 26, as is conventional. Orbiting scroll 24 in its orbiting motion coacts with fixed scroll 28 to trap volumes of gas which are compressed and exhausted through discharge port 30 and discharge tube 32 into discharge chamber 16 which is in fluid communication with a refrigeration system or air conditioning (not illustrated). In trapping volumes of gas, the scrolls 24 and 28 create a partial vacuum which draws gas into compressor 10. Specifically, there is a generally confined fluid path serially including suction inlet 34 and duct member 42 which connects directly with the inlet of scrolls 24 and 28 which define the suction source. Gas entering compressor 10 via suction inlet 34 impinges upon the surface of duct member 42.

If port 42-1 is open, as shown in FIG. 2, some of the entering flow will flow directly through port 42-1 and over motor 18 to produce cooling. While the partial vacuum at the scrolls favors the flow of gas upwardly to the scrolls, impingement tends to produce an omnidirectional, but unevenly distributed flow. As a result, some of the flow will be diverted towards port 42-1 and will flow into the interior of shell 12 and over motor 18. It is not essential to have a uniform flow since localized cooling of motor 18 by convection will produce cooling in other areas due to conduction.

The major portion of the flow entering suction inlet 34 impinges on duct member 42 and then moves upwardly through the flow path defined by duct member 42 and shell 12 into horizontal leg 42-2 and then into the inlet of scrolls 24 and 28. A clearance between scroll 24 and horizontal leg 42-2 defines aspiration inlet 48 which draws in gas leaked or supplied to the interior of shell 12 via outlet 42-1 thereby recombining the motor cooling flow with the main flow. Valve 44 coacts with port 42-1 to control the diverted motor cooling flow. Valve 44 is made of a bimetal or shape memory material such as nitinol and is secured to the compressor shell 12 or stator of motor 18 in a heat transfer relationship. Valve 44 will normally be in a position blocking port 42-1 when motor 18 is at an acceptable operating temperature. The only gas flowing into the interior of the shell will be a predetermined leakage flow past valve 44 and between duct member 42 and shell 12. The leakage flow will tend to be aspirated into the main flow via aspiration inlet 48. As motor 18 heats up, valve 44 will heat up also and flex away from port 42-1 thereby permitting a bypass flow with valve 44 going from the FIG. 1 position to the FIG. 2 position. The bypass flow will flow over and cool motor 18 before being aspirated into the main flow via aspiration inlet 48. Valve 44 can be configured to open fully and then close when the motor is sufficiently cooled in a cycle of opening and closing. Also, valve 44 can be configured to vary the degree of bypass flow to maintain the motor at a temperature below a predetermined level. Valve 44 can also be one of a series of valves each operating in a manner described at the same temperature or at different temperatures to give a better degree of control.

FIG. 3 shows a modified suction inlet duct 140 with two thermostatic valves 144 and 145 coacting with ports 142-1 and 142-2, respectively. Valves 144 and 145 are similar to valve 44 but can provide a greater bypass flow as well as greater control if the valves operate at different temperatures or if the degree of opening is temperature related. The operation of the modified suction inlet duct 140 and valves 144 and 145 would otherwise be the same as that of suction inlet duct 40 and valve 44.

Figure 4:
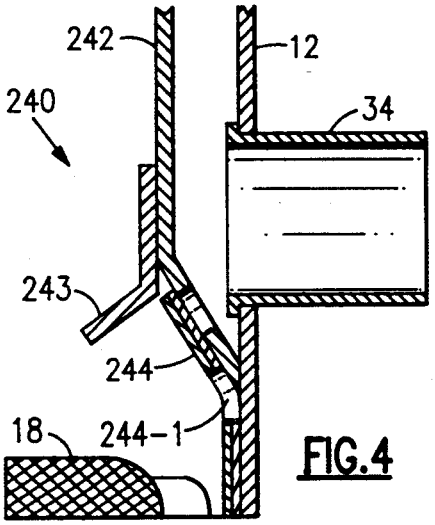
FIG. 4 is a sectional view of a second modified suction inlet duct valve in the closed position.
Figure 5:
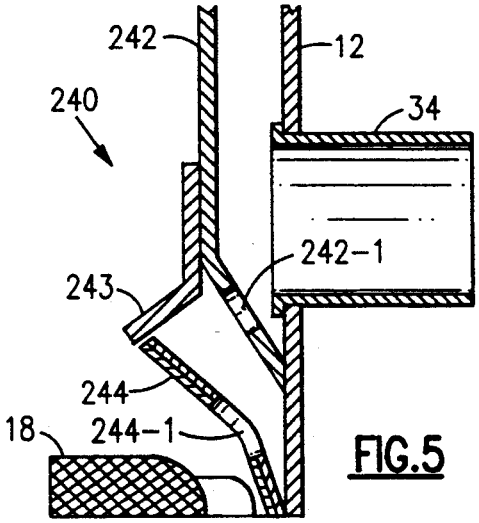
FIG. 5 is a sectional view of the valve of FIG. 4 in the open position.

In FIGS. 4 and 5, the numeral 240 designates a second modified suction inlet duct and the numeral 244 designates a modified valve. Suction inlet duct 240 differs from duct 40 in the addition of deflector 243 which is suitably secured to duct member 242. Valve 244 differs from valve 44 in the addition of port 244-1. When valve 244 is open, as shown in FIG. 5, gas entering suction inlet 34 and passing through port 242-1 will be diverted by deflector 243 which prevents flow from going directly to aspiration inlet 48. Rather, the flow is diverted circumferentially around the shell 12 and downwardly where the flow can pass through port 244-1. The circumferentially diverted flow plus that through port 244-1 tends to pass over and cool motor 18.

Figure 6:
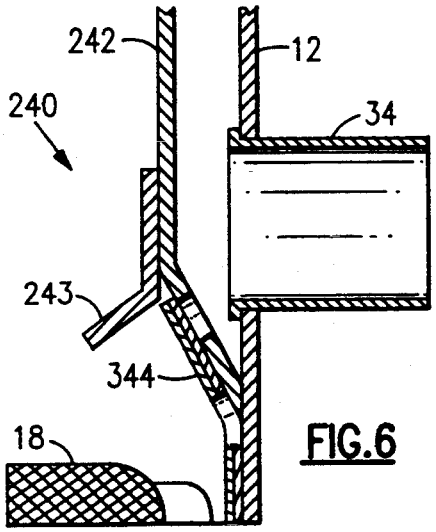
FIG. 6 is a sectional view of a third modified suction inlet duct valve in the closed position.
Figure 7:
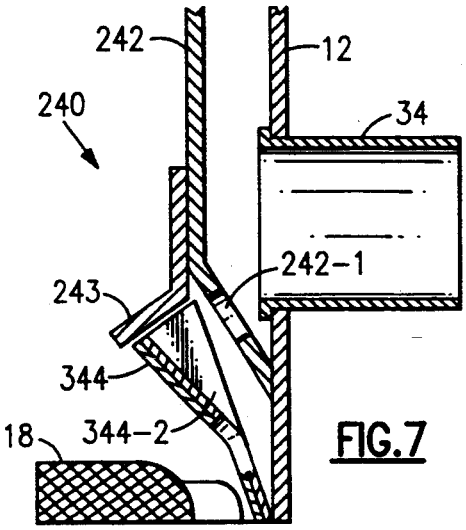
FIG. 7 is a sectional view of the valve of FIG. 6 in the open position.
Figure 8:
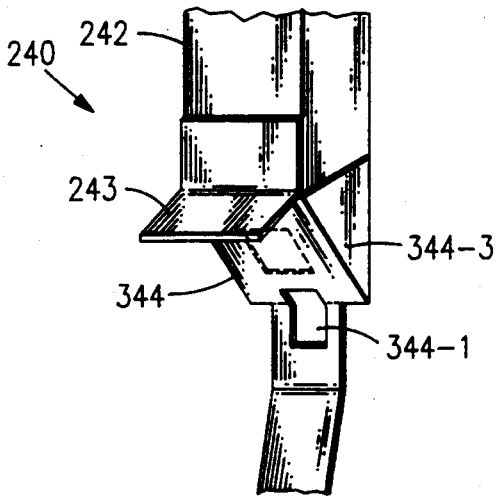
FIG. 8 is a pictorial view of the valve of FIG. 6.

In FIGS. 6 through 8, the numeral 240 designates a suction inlet duct identical to that of FIGS. 4 and 5, while the numeral 344 designates a third modified valve. Valve 344 differs from valve 244 by the addition of sides or wings 344-2 and 344-3. Sides 344-2 and 344-3 coact with deflector 243 to deflect most of the gas passing through port 242-1 downwardly with at least a portion going through port 344-1. The rest of the gas will tend to flow circumferentially along the interior of shell 12 after passing between sides 344-2 and 344-3 and the shell.

Figure 9:
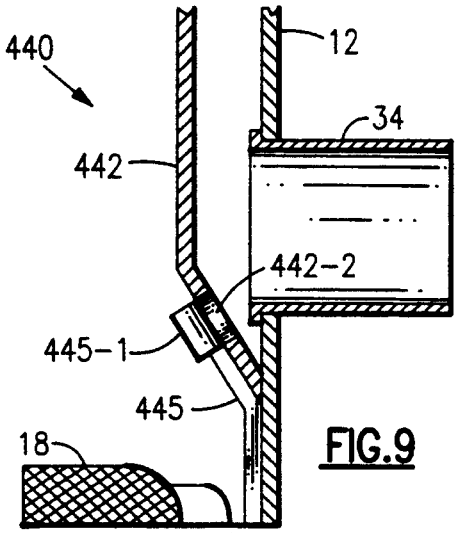
FIG. 9 is a sectional view of a fourth modified suction inlet duct valve arrangement with a valve in the closed position.
Figure 10:
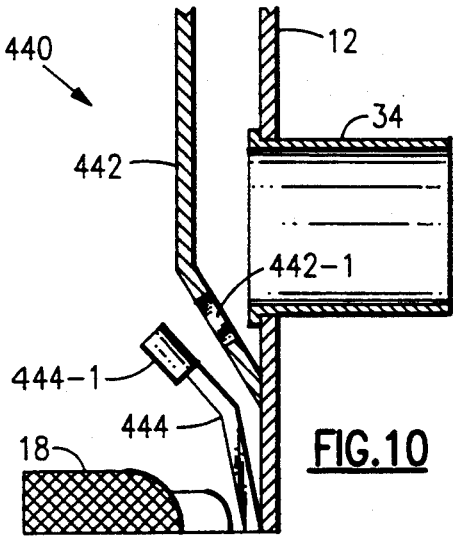
FIG. 10 is a sectional view of the duct valve arrangement of FIG. 9 with a valve in the open position.
Figure 11:
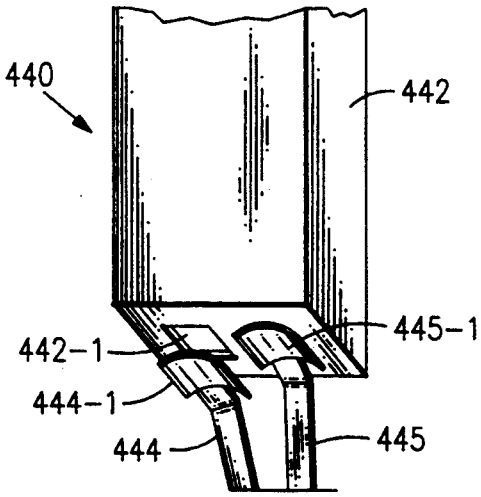
FIG. 11 is a pictorial view of the valve arrangement of FIG. 9.

In FIGS. 9 through 11, the numeral 440 designates a modified suction inlet duct and the numerals 444 and 445 designate modified valves. Duct member 442 has a pair of ports 442-1 and 442-2 which coact with valves 444 and 445, respectively. When the heating of valve(s) 444 and/or 445 causes it to unseat, a portion of the gas entering the compressor via suction inlet 34 passes through the port(s) 442-1 and/or 442-2. Because valves 444 and 445 have curved portions 444-1 and 445-1, respectively, coacting with ports 442-1 and 442-2, gas passing through the ports tends to be diverted in the direction of the curve and thereby over the motor 18.

Although preferred embodiments of the present invention have been illustrated and described in terms of a vertical scroll compressor, other changes will occur to those skilled in the art. For example, the amount of cooling flow, how it is directed and its path may be changed due to design requirements. Also, the present invention is adaptable to other low-side hermetic compressors. It is therefore intended that the present invention is to be limited only by the scope of the appended claims.

What is claimed is:

1. A low side hermetic compressor means comprising:

shell means;

running gear within said shell means and having an inlet for supplying fluid to said running gear;

motor means for driving said running gear to cause compression of fluid supplied thereto;

a suction inlet extending through said shell means;

suction inlet duct means within said shell means and including a portion facing said suction inlet, port means, thermostatic valve means coacting with said port means and a fluid path leading to said inlet of said running gear;

said valve means being in heat transfer relationship with at least one of said shell means and said motor means whereby said thermostatic valve means obturates or uncovers said port means to regulate a motor cooling bypass flow responsive to motor temperature.

2. The compressor means of claim 1 wherein said valve means includes a plurality of valves.

3. The compressor means of claim 2 wherein at least two of said valves have different thermal responses.

4. The compressor means of claim 1 wherein said valve means are made of shape memory material.

5. The compressor means of claim 1 wherein said valve means are made of a bimetal material.

6. The compressor means of claim 1 wherein said suction inlet duct means includes means for diverting flow passing through said port means such that cooling of said motor means takes place.

7. The compressor means of claim 6 wherein said means for diverting flow is at least partially located on said portion facing said suction inlet.

8. The compressor means of claim 6 wherein said means for diverting flow is at least partially located on said valve means.

* * * * *